United States Patent [19]

Hale

[11] Patent Number: 4,465,266

[45] Date of Patent: Aug. 14, 1984

[54] POWER UNIT FOR MEDICAL AND LIKE STOOLS AND CHAIRS

[75] Inventor: Dean H. Hale, Logan, Utah

[73] Assignee: Hale Chairco Corporation, Salt Lake City, Utah

[21] Appl. No.: 355,447

[22] Filed: Mar. 8, 1982

[51] Int. Cl.[3] ..... A47C 7/14

[52] U.S. Cl. ..... 267/131; 297/345

[58] Field of Search ..... 188/322.18; 267/131; 297/345

[56] References Cited

U.S. PATENT DOCUMENTS

| | | | |
|---|---|---|---|
| 3,444,965 | 5/1969 | Dobkins | 188/322.18 X |
| 3,486,417 | 12/1969 | Di Vita et al. | 267/131 X |
| 4,124,202 | 11/1978 | Hatakeyama | 267/131 X |
| 4,222,555 | 9/1980 | Eimen | 267/131 |
| 4,245,826 | 1/1981 | Wirges | 297/345 X |

FOREIGN PATENT DOCUMENTS

| | | | |
|---|---|---|---|
| 1410983 | 10/1975 | United Kingdom | 297/345 |

*Primary Examiner*—Duane A. Reger

*Attorney, Agent, or Firm*—Lynn G. Foster

[57] ABSTRACT

A power unit for medical and like stools and chairs, the first disclosed power unit comprising a post assembly comprising a cylinder, a ram or piston tube which telescopes within the cylinder and a reservoir containing oil under pressure of compressed air, which reservoir is carried by and wrapped slenderly and cylindrically around the lower part of the ram. A dip tube in the reservoir accommodates oil flow across a two piece interiorly and exteriorly sealed plastic control valve disposed in the hollow of the ram, adjacent the top of the reservoir, by which (a) the effective length of the power unit is extended and retracted depending on whether the weight of the user is imposed on a seat carried by the upper end of the ram tube when the control valve is caused to be opened by manual manipulation of a lever pivotally secured to the ram tube above the control valve and (b) any selected length is retained when the control valve is closed. A sealed plastic annular bearing carried in tongue and groove relation with an internal metal sleeve force fit into the lower end of the ram tube creates and retains a sealed relation between the piston tube and the cylinder at all times. Two additional embodiments are disclosed.

21 Claims, 6 Drawing Figures

POWER UNIT FOR MEDICAL AND LIKE STOOLS AND CHAIRS

BACKGROUND

1. Field of Invention

This invention relates generally to a power unit and more particularly to a novel power unit for medical and like stools and chairs, which can be selectively extended and retracted by the operator and comprises a ram, a cylinder into which the ram telescopically reciprocates, a tank encircling or adjacent the cylinder and the ram thereby providing a reservoir of oil pressurized by air for telescopically changing the effective length of the unit, a plastic control valve, a plastic bearing and hydraulic seels to prevent leakage of oil.

2. Prior Art

Power units used as stools and chairs and accommodating extension and retraction of a ram telescopically within a cylinder have heretofore required expensive high tolerance metal parts throughout including a complex metal control valve together with extensive actuator structure and a bulky cone-shaped reservoir-forming tank concentrically disposed at the top of the ram in which the control valve is inaccessibly disposed and operably below the pressurized oil level in the reservoir. Because of flaws in tubular material used to manufacture such power units, among other reasons, oil leakage frequently occurs creating serious operational and cleanliness problems.

In view of the foregoing, power units of the type in question are in need of improvement to provide better reliability, lower costs, better valve access for repair, simpler actuation, easier connectability to a stool seat, less bulk and weight and improved configuration, and elimination of hydraulic leakage.

BRIEF SUMMARY AND OBJECTS OF THE INVENTION

The present invention overcomes the aforementioned disadvantages of the prior art by providing in one form a novel slender power unit, for medical and like stools and chairs, comprising a cylinder, a reciprocable ram or piston tube telescopically disposed within the cylinder and a unique wrap-around reservoir tank mounted to cylindrically surround and skirt the lower end of the cylinder. A plastic two-piece valve is accessibly carried within the ram near the top of the relatively low reservoir tank and operated by a highly simplified and conveniently located actuator. Interior and exterior valve seals prevent leakage across the plastic control valve. A dip tube novelly accommodates oil flow between the reservoir and the interior of the cylinder and the ram across the control valve to telescopically alter the effective length of the power unit. Preferably the top end of the ram facilely accommodates mounting of a stool seat or the like.

A plastic annular bearing carried at the lower end of the ram novelly seals the ram to the interior of the cylinder and is secured by a tongue-in-groove union with an interior metal support sleeve, which in turn is force-fit into the hollow interior of the ram at the lower end thereof.

In another form the present invention comprises a power unit of the type aforementioned wherein a reservoir tank, containing oil under pressure, and a control valve are disposed in spaced relation from a cylinder assembly comprising a ram telescopically reciprocated within a cylinder to selectively change the effective length of the power unit. A further form of the instant invention comprises a power unit of the type under consideration wherein the control valve is within the ram and the reservoir tank is adjacent the ram below or above the elevation of the control valve.

With the foregoing in mind, it is a primary object of the present invention to provide improved power units for medical and like stools.

An additional important object is the provision of power units having novel reservoir tank structure.

An additional significant object is the provision by the present invention of power units having a wrap-around reservoir tank.

An additional dominant object of the present invention is to provide power units having an elongated annular reservoir tank juxtaposed and forming a skirt around the lower end of a ram.

A further paramount object of the present invention is the provision of power units having a relatively low reservoir tank mounted in a relatively low position on a cylinder assembly thereof and a unique dip tube which novelly accommodates flow of oil between the reservoir and the interior of the cylinder assembly across a control valve to telescopically alter the effective length of the power unit as desired by the user.

A further object of significance is the provision of power units of the type under consideration comprising a novel control valve.

A further dominant object is the provision of power units each having a novel two-piece plastic control valve carried within and novelly sealed to the hollow interior of the ram of the cylinder assembly.

A further important object is the provision of a novel manual valve actuator in a power unit comprising a telescopic cylinder assembly.

A further paramount object of the present invention is the provision of a power unit having a novel oil sealing system.

A further object of importance is the provision of a power unit which accommodates easy mounting of a stool seat or chair at the upper end of the ram thereof.

A further object of significance is the provision of a power unit for medical and like stools and chairs which utilizes an annular interior bearing, novelly sealed to the cylinder of a cylinder assembly, the bearing being annular in configuration and formed of plastic carried in tongue and groove relationship by a metal interior support sleeve which in turn is securedly and a reservoir tank for hydraulically extending and retracting the effective length of the cylinder assembly mounted in spaced relation to the cylinder assembly.

A further object of the present invention is the provision of a novel accessible control valve disposed in a pressurized tank containing oil by which a remote cylinder assembly is controlled to extend and retract telescopically the effective length thereof.

An additional primary object of the present invention is the provision of a power unit wherein a cylinder assembly thereof is separate though hydraulically interconnected with a reservoir tank thereof.

It is also a principal object to provide a power unit wherein a cylinder assembly thereof comprises a ram containing a control valve in the hollow interior of the ram hydraulically interconnected within a pressurized reservoir tank located at an elevation substantially below or above the control valve.

These and other objects and features of the present invention will be apparent from the detailed description taken with reference to the accompanying drawings.

DETAILED DESCRIPTION OF THE ILLUSTRATED EMBODIMENTS

Figure 1:
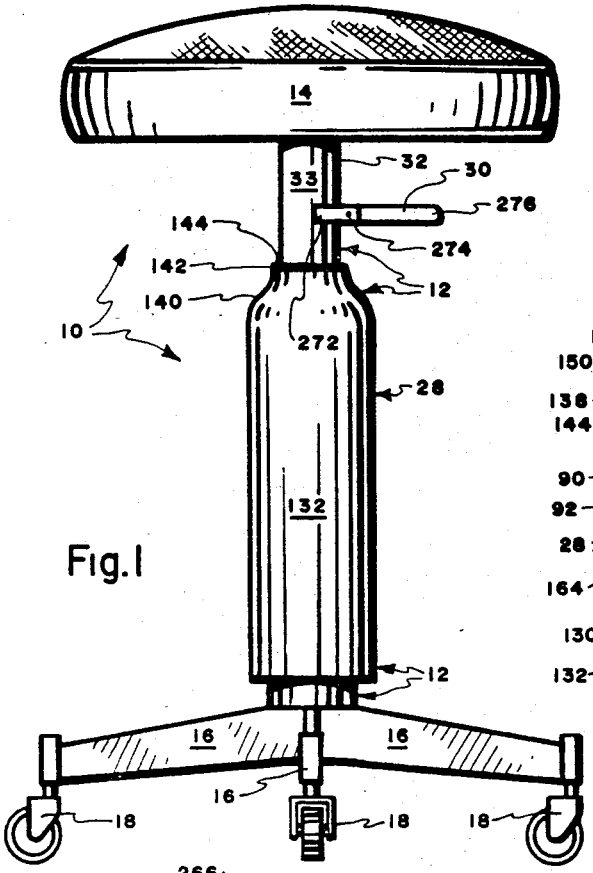
FIG. 1 is a side elevation of a stool embodying one form of the present invention, the stool being shown in its lower or retracted position.

Reference is now made to the drawings wherein like numerals are used to designate like parts throughout and which in particular illustrate a stool, generally designated 10, fabricated in accordance with the principles of the present invention. Stool 10 comprises a power unit, generally designated 12, which is illustrated as being interposed between a conventional seat 14 and a conventional base 16, which comprises conventional floor-engaging casters 18. The seat 14 may be of any style or configuration as may be the base 16.

Figure 3:
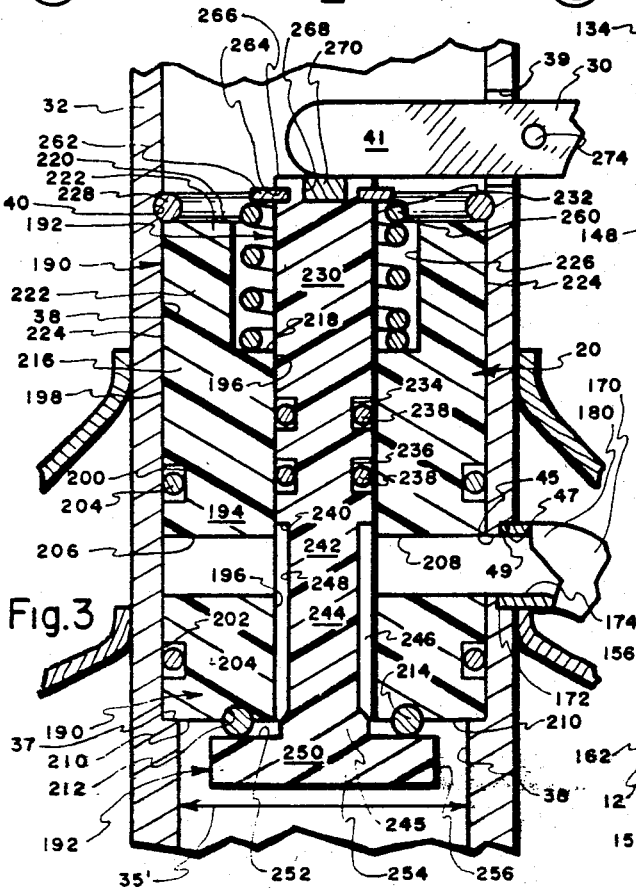
FIG. 3 is an enlarged fragmentary cross section of the control valve of the power unit of FIG. 2.
Figure 2:
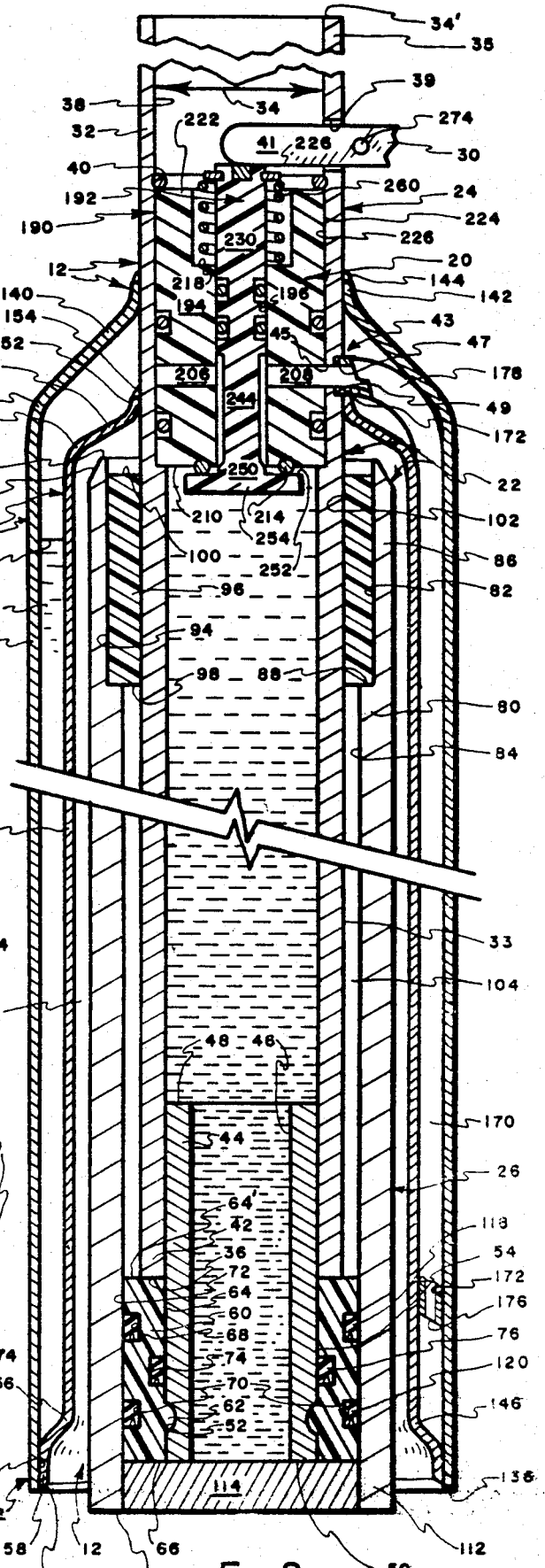
FIG. 2 is an enlarged vertical cross section through the power unit or cylinder assembly of the stool of FIG. 1.

Reference is now made specifically to FIGS. 2 and 3 which illustrate, respectively, the power unit 12 and a control valve assembly, generally designated 20, which forms a part of the power unit 12.

Broadly, power unit 12 (FIG. 2) comprises a cylinder assembly, generally designated 22, which in turn comprises a ram, generally designated 24 and a cylinder, generally designated 26, a reservoir tank, generally designated 28 containing oil under pressure of compressed air or gas, the previously mentioned two piece plastic control valve 20 and a manual actuator 30.

More specifically, ram 24 comprises a hollow cylindrical tube 32 preferably of mild steel, having a stepped interior surface 38 comprising an upper greater diameter 34 and a lower diameter 35'. The tube 32 terminates in an upper edge 34' disposed in a horizontal plane and a lower edge 36 also disposed in a horizontal plane. The seat 14 may be attached in any suitable fashion to the upper edge 34 of the tube 32 or to the upper end 35 of the tube 32 to accommodate convenient mounting of any commercially available stool or like seat. The upper end 35 of the tube 32 is interrupted by an aperture 39 sized and shaped to loosely receive the interior end 41 of the power unit actuator 30. The interior surface 38 of the tube 32 comprises an interior annular groove 40 adjacent the actuator 30. The interior surface 38 of tube 32 is stepped or enlarged at shoulder 37.

A stepped aperture or bore is provided in tube 32 at site 43, disposed below both aperture 39 and the interior groove 40 within the reservoir tank 28. A stepped aperture at site 43 comprises a relatively small diameter port 45 at the interior of the tube 32, an enlarged diameter port 47 opening at the exterior of the tube 32 and a shoulder 49 between the two ports.

At the lower end 42 of tube 32 is disposed a sleeve 44 force fit for approximately one-half its length into the hollow interior 38 of the sleeve 32 so as to be rigidly retained in the illustrated position. The tube 44 comprises a hollow cylindrical interior 46, an upper edge 48, a lower edge 50 and an annular groove 52 disposed in the outside surface 54 thereof in a horizontal attitude just above the lower edge 50. It is presently preferred that the sleeve 44 comprise mild steel.

An annular bearing 60 is carried in tongue-in-groove relation contiguously over the lower one-half of the sleeve 44. The annular bearing 60 is fabricated to present an annular protrusion 62 along the interior surface 64 sized and shaped to be contiguously force fit in male/female mating relation as illustrated in FIG. 2. Plastic annular bearing 60 further comprises an upper edge 64' contiguously disposed against the lower edge 66 of the tube 32 in the same horizontal plane as is lower edge 50 of the sleeve 44. Plastic annular bearing 60 also comprises a lower edge 66 disposed in a horizontal plane as well as two spaced horizontally oriented seal-receiving annular grooves 68 and 70 along the exterior surface 72. Bearing 60 also comprises a horizontally oriented seal receiving annular groove 74 along the interior surface 64. An O-ring 76 is disposed in groove 74 in compressed relation to prevent seepage of oil or hydraulic fluid from the interior of the cylinder assembly 22 along the interface between the sleeve 44 and the annular bearing 60.

Bearing 60 is formed of a relatively hard wear resistant synthetic resinous material.

With the foregoing in mind, it should be readily appreciated that the ram tube 32, the sleeve 44 and the annular bearing 60 reciprocate as a unit within the cylinder 26 selectively, upon control of the user, as hereinafter explained in greater detail.

The cylinder 26 comprises a tube 80, formed preferably of mild steel, having stepped interior surfaces 82 and 83, respectively, the diameter of surface 82 being greater than the diameter of surface 84, which in turn has a greater diameter than the exterior cylindrical surface 33 of the tube 32. The stepped relationship between the surfaces 82 and 84 of tube 80 is that the upper end 86 of the tube thereby forming a shoulder 88. Tube 80 terminates at upper edge 90, which is disposed in a horizontal plane and merges with a bevelled surface 92 which in turn merges with the exterior cylindrical surface 94 of the tube 80.

An annular plastic bearing 96 is force fit into contiguous retained relation with surface 82 of tube 80 so that the lower edge 98 of bearing 96 is flush with shoulder 88. The upper edge 100 is disposed horizontally at a location below edge 90 of tube 80. The interior cylindrical surface 102 of annular bearing 96 has a diameter essentially the same as the diameter of the exterior surface 33 of the tube 32 so that a close tolerance relationship exists between surfaces 102 and 33 whereby alignment between the tubes 32 and 80 is maintained at all times and non binding low friction reciprocation accommodated.

Tube 80 comprises a lower end 112 terminating in an edge 110 disposed in a horizontal plane. The interior diameter 84 at lower end 112 is caused to be air tight and reinforced by a contiguous plate or disc 114, the diameter of the peripheral edge of disc 114 being substantially the same as the interior diameter of the surface 84 of the tube 80. Disc 114 is welded or otherwise rigidly secured in the position illustrated in FIG. 2. Thus, disc 114 forms the base of the cylinder 26.

The interface between the interior surface 84 of the tube 80 and the exterior surface 72 of the plastic annular bearing 60 accommodates sealed linear reciprocation obviating oil leakage by reason of lip seals 118 and 120 compressively disposed in annular exterior grooves 68 and 70 of the bearing 60. Thus, migration of hydraulic fluid under pressure along the interface formed by surfaces 84 and 72 is no more than a negligible amount if any.

Reservoir tank 28 is mounted relatively low on and in integral relation with tube 32 and comprises an annular wrap-around interior reservoir 130, a cylindrical configuration, formed by an exterior cylindrical wall 132 preferably of mild steel and an inner cylindrical wall 134 preferably of mild steel. The space between the walls 132 and 134 is narrow, selected, in conjunction with the length of the reservoir tank to provide a sufficient supply of hydraulic fluid to fully accommodate complete extension and retraction of the ram 24.

Tank wall 132 has a generally uniform diameter through the entire length from the bottom edge 136 to curve site 138 where the wall 132 presents a dog leg reverse curve configuration 140 so that the interior diameter of the upper end 142 thereof is the same as the exterior diameter of surface 33 of tube 32. The upper edge 144 is secured to the exterior surface 33 of the tube 32 in integral air tight relation by welding or the like.

Wall 134 has a uniform diameter and cylindrical configuration between upper curve site 144 and lower curve site 146. The diameter of wall 134 is greater than the exterior diameter formed by surface 94 of tube 80 thereby providing an annular space 148 between the tube 80 and the wall 134. The space 148 is small, however, to add significantly to the overall streamlined slender configuration of the power unit 12.

The top portion of the wall 134 comprises an inwardly directed reverse curve portion 150 which begins at site 144 and ends at reduced diameter upper end 152. The interior diameter of upper end 152 is identical to the exterior diameter of surface 33 of tube 32. The upper edge 154 of wall 134 is secured integrally in the illustrated position in air tight relation by welding or the like.

The lower portion of the wall 134 comprises an outwardly directed reverse curve configuration beginning at site 156 and ending in enlarged cylindrical portion 158 which terminates in a bevelled edge 160. The exterior diameter of lower end portion 158 is the same as the interior diameter of the lower end of tank wall 132 with the interface 162 therebetween being integrally connected in sealed air tight relation as by welding or the like. Thus, the interior reservoir 130 between the tank walls 132 and 134 is liquid and air tight with the lower portion thereof being filled with oil and the upper portion, above site 164, as illustrated in FIG. 2, comprising compressed air. The reservoir at the top is formed not only by tank walls 132 and 134 but by a small length of the aforedescribed tube 32.

The reservoir tank 28 comprises a dip tube 170 which snugly fits between the tank walls 132 and 134. The dip tube 170 comprises an annular cylindrical wall 172, a hollow interior passageway of uniform diameter 174 and a lower diagonal edge 176. Edge 176 is spaced a short distance above the lowest point in the oil reservoir 130. Tube 170 extends throughout most of its length in an upward vertical direction. The upper end of tube 170, however, comprises a right angle elbow 178 terminating in horizontally directed end 180, which is force fit into port 47 disposed in the wall of tube 32, so as to be contiguous with shoulder 49.

Thus, dip tube 170 provides a channel by which the oil or hydraulic fluid flows between reservoir 130 and the interior of the ram tube 32 via the interior passageway 174 and aligned stepped tube ports 47 and 45.

Control valve 20 is disposed adjacent the top of reservoir tank 28 immediately below lever 30 and comprises an exterior generally annular plastic stationary portion, generally designated 190, and a reciprocable plastic plunger, generally designated 192, disposed concentrically within the stationary member 190. Stationary member 190 rests upon shoulder 37 and is contiguous with the interior of tube 32 immediately above shoulder 37.

Stationary member 190 comprises an annular body portion 194, having a central bore or passageway of uniform diameter throughout concentric with the axes of the stationary member 196 and the tube 32. The exterior cylindrical surface 198 of the main body portion 194 is of uniform diameter throughout its length but is interrupted by two annular horizontally disposed grooves 200 and 202, each containing an O-ring 204 in a compressed state which provides an extraordinarily reliable sealed interface between the tube 32 and the body 190 whereby oil or hydraulic fluid leakage across the exterior of the control valve 20 is prevented.

Main body 194 is also interrupted by two aligned radially directed horizontally oriented ports 206 and 208. Passageways 206 and 208 are aligned and of identical diameter and span between the interior and exterior surfaces 196 and 198 of the main body portion 194. One of the passageways 206 and 208 (illustrated as 208 in FIG. 3) is caused to be aligned and in fluid communication with port 45 in tube 32 to accommodate flow of hydraulic fluid between the interior 174 of tube 170 and the interior of the stationary member 190.

Main body portion 194 of stationary member 190 comprises a bottom horizontally disposed face 210 interrupted by a groove 212 disposed concentrically in respect to the axial bore 196. Groove 212 retains therein a relatively large O-ring 214.

Main body 194 of stationary member 190 is interiorly stepped adjacent site 216 to form a horizontally disposed annular shoulder 128. An axially directed annulus 222 extends upwardly contiguous with the interior surface of tube 32 and concentrically in respect to central bore 196 from site 216 and connects to shoulder 218. Axially directed annulus 222 comprises a smooth cylindrical exterior surface 224 and a smooth cylindrical interior surface 226.

A metal lock ring 228 is force fit into groove 40 at the interior surface of tube 32 so as to contiguously bear against the top edge 220 of the stationary member 190 thereby retaining the control valve in its installed illustrated position. A snug relationship also exists between the exterior surface 198 of the stationary member 190 and the interior surface of the tube 32 within diameter 34 above shoulder 37 retaining the control valve in its assembled operative position as illustrated in FIGS. 2 and 3.

Plastic plunger 192 is generally cylindrical in configuration comprising a central shaft 230 having an exterior cylindrical surface 232 selected to snugly fit within the bore 196 of stationary member 190 for limited reciprocation.

The exterior surface 232 is interrupted by two horizontally disposed grooves 234 and 236, each of which receives a compressed O-ring seal 238 which creates and retains a liquid and air tight seal between the plunger 192 and the central bore 196 of the stationary member 190 preventing leakage of oil or hydraulic fluid during use.

Shaft 230 is stepped to a reduced diameter at a site 242 forming shoulder 240 just above passageways 206 and 208 of stationary member 190. Thus, plunger 190 comprises a cylindrical portion 244 of uniform diameter spanning essentially between side ports 206 and site 245. Thus, an annular space or passageway 246 is provided between the interior surface 196 of the stationary member 190 and the exterior surface 248 of cylindrical portion 244 of plunger 192. This facilitates selective flow of hydraulic fluid or oil between the interior of the tube 32 below the control valve 20 and the reservoir 130 under control of the user. The cylindrical enlargement at 245 fits closely within bore 196 thereby accommodating pressure equalization on both sides of O-ring 214. This prevents O-ring 214 from pulling out.

Plunger 192 is further enlarged at site 250 to form an annular shoulder 252 which comprises part of an enlarged disc shaped head 254. The diameter of the radial surface 256 of plunger head 254 is greater than the diameter of the seal 214 accommodating compressive engagement between the seal 214 and the shoulder 252 under force of spring 260 to close the control valve 20.

Plunger 192 is urged toward its illustrated and described closed position (See FIG. 3) by compression spring 260 located near the top of the shaft 230 of the plunger 192. The diameter of the spring 262 is greater than the diameter of the shaft 232 but less than the diameter of the interior cylindrical surface 226 of annulus 222. The lower end of the spring 260 abuts against shoulder 218 while the upper end of the spring 260 contiguously engages a snap ring 262 retained in a groove 264 near the top surface 266 of the shaft 230.

Stationary member and plunger 192 are formed of a relatively hard elastomeric synthetic resinous material of any suitable commercially available type.

The top surface 266 is interrupted by a concentric disc shaped recess 268 into which a wear resistant metal disc 270 is force fit. The interior portion 41 of the manual actuator 30 is disposed so as to be normally contiguous with the metal insert 270. A metal bracket 272 (FIG. 1) pivotally supports the actuator 30 via pin 274. By grasping the exposed end 276 (FIG. 1), the lever or manual actuator 30 may be pulled up causing end 41 to pivot about pin 274 downwardly against metal wear insert 270 thereby displacing the plunger 192 counter to the force of spring 260 downwardly causing the shoulder 252 of plunger disc 254 to become separated from the seal 214 and thereby providing a flow path between the space 246 and the interior of the tube 32 beneath the control valve 20.

The stool seat 14 (FIG. 1) will descend when the plunger 192 is open and the weight of the user is imposed upon the seat 14 causing the ram tube 32 to descend telescopically within the cylinder 26. When the control valve 20 is open by manipulation of the actuator 30 and the weight of the user is not on the seat 14, the compressed air pressure upon the oil in reservoir 130 will cause oil to flow from the reservoir through the dip tube 170, across port 45, along valve passageway 208 into annular chamber 246 and from thence between shoulder 252 and seal 214 into the interior of the tube 32 beneath the control valve 20 causing the ram 24 to extend telescopically outward from the cylinder 26. In this way, the particular height of the stool may be set and adjusted from time to time as desired by the user.

Figure 4:
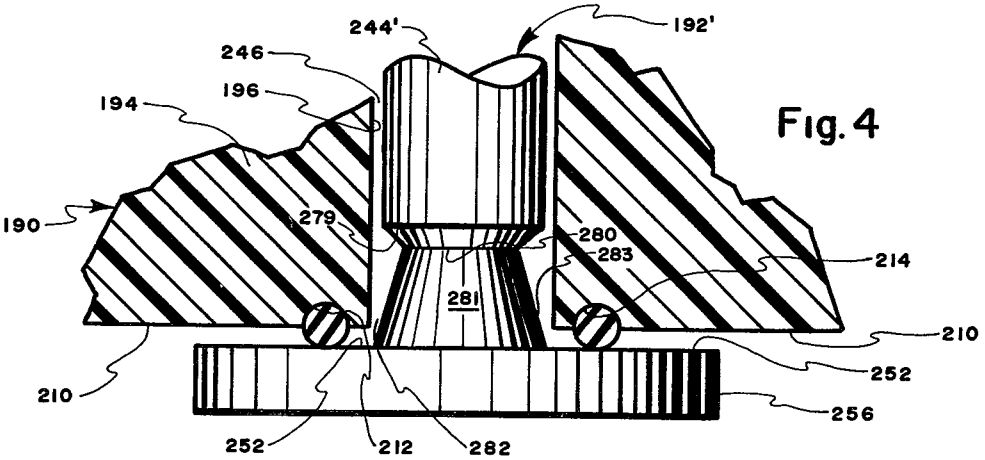
FIG. 4 is an enlarged fragmentary cross section of a modified control valve plunger.

Reference is now made to FIG. 4 which illustrates a modified form of the control valve and more particularly a control valve having a modified plunger 192'. The stationary member 190, previously described, remains the same as does the previously described plunger except that the lower portion 244' is tapered from site 279 to a neck at annular site 280 thereby comprising the top part of an hour glass configuration. The downwardly divergent conical wall 283 of the lower part 281 of the hour glass configuration defines a variable sized flow path between stationary member 190 and plunger 192' when open. More specifically, the clearance between surface 283 of the plunger 192' and bore surface 196 of stationary member 190 will vary with the displacement of plunger 192'. Preferably, the annular opening 282 will vary between 1/32 inch and 1/16 inch when the valve is open. Thus, when plunger 192' is displaced downwardly by manipulation of actuator 30 limited flow of oil under pressure between plunger head surface 252 and O-ring 214 will be accommodated by an initial small clearance. As the plunger 192' continues its downward displacement the rate of flow will gradually increase. It is presently preferred that the maximum annular space provided at site 280 of plunger 192' adjacent the lower end of bore 196 be sized to accommodate the desired rate of maximum telescopic displacement. Thus, the control valve of FIG. 4 provides the user of the power unit in question with the ability to control the speed of descent and the speed of ascent by controlling the magnitude of displacement manually imparted to actuator 30.

Figure 5:
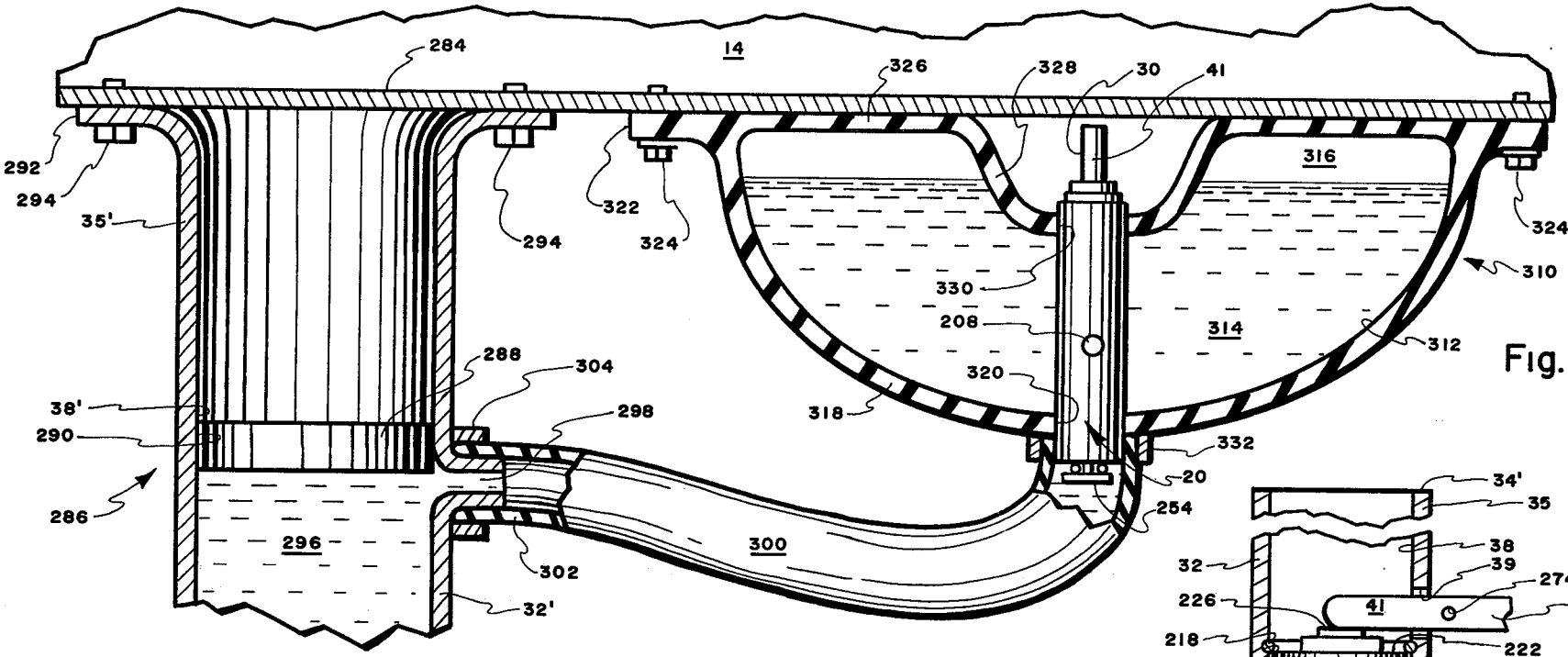
FIG. 5 is an enlarged fragmentary cross sectional view of a stool embodying a second form of the present invention.

Reference is now made to FIG. 5 which illustrates a modified form of the present power unit invention. Seat 14 is illustrated as having a solid base 284 of metal or other rigid material. Except as here described, the cylinder assembly described in conjunction with FIG. 2 remains the same. Tube 32' of power unit assembly 286 (FIG. 5) differs from tube 32 in that interior groove 40 does not exist, a control valve is not disposed within the hollow interior 38' of tube 32' and a solid leak proof metal or plastic disc shaped plug 288 is force fit into the hollow interior 38' of tube 32' directly aligned with the top of port 298 (to avoid any build up of stray compressed gas). Furthermore, the upper end 35' is flaired through 90 degrees to form a radial flange 292 cap screw or otherwise secured at sites 294 to the seat 14 at rigid bottom 284. The hollow interior of tube 32' beneath plug 288 comprises a variable volume reservoir of oil 296, the amount of oil therein depending upon the effective length at any particular time established by the previously described telescopic displacement of the tube 32' in respect to the associated cylinder.

Tube 32' is interrupted by a flanged sidewall port 298 at a site below plug 288 to accommodate selective communication of oil to and from the variable volume tube reservoir 296. Such selective oil communication is accommodated by a flexible reinforced hose 300 of suitable strength and material the end 302 of which is secured to the port 298 by a conventional coupling 304, which is schematically illustrated. Any commercially available flexible hose and coupling or unions may be used.

Power unit assembly 286 comprises a spaced or remote reservoir tank, generally designated 310. Reservoir tank 310 comprises a hollow interior 312 and is formed of a commercially available synthetic resinous material having sufficient strength to accommodate the required mounting, interior pressures and which is resistant to the hydraulic fluid or oil 314 disposed within the oil reservoir 314 at the hollow interior 312. Reinforced neoprene is suitable. Pressurized air exists in space 316 within the hollow interior 312. The reservoir tank 310 comprises a rounded bottom wall 318 centrally interrupted by an aperture 320. Reservoir tank 310 also comprises an annular elevated flange 322 by which the reservoir tank 310 is mounted to the bottom 284 of the seat 14 by cap screws or the like at sites 324.

Reservoir tank 310 also comprises an upper wall 326 which is downwardly recessed at central site 328 to form an aperture 330. The apertures 320 and 330 are vertically aligned and sized and shaped to snugly receive the previously described control valve 20 in firm air and liquid tight relation. The valve 20, for example, may be bonded or otherwise suitably secured to the reservoir tank 310 at aperture sites 320 and 330. Alternatively the control valve may be located at the end of base 300 adjacent to or contiguous with but outside the tube 32' or within the tube 32' per se.

The recess 328 in the top surface 326 is sized and shaped so as to accommodate exposure of the top of the control valve 20 and to provide sufficient clearance for pivoting lever 30 to force end 41 downward against the plunger of control valve 20 to accommodate flow of hydraulic fluid or oil between the tube reservoir 296 and the remote reservoir tank 310. Lever 30 is pivotally mounted to the undersurface 284 of the seat 14 to accommodate the previously described pivotal action.

Conventional coupling 332, diagramatically illustrated, connects the other end of the flexible hose 300 to the wall 318 of the reservoir 310 concentrically around the aperture 320 and the lower end of the control valve 20 to accommodate change in the effective length of the power unit in the manner heretofore described.

It should be appreciated and understood that while the detailed description is directed to a stool utilization of the described power unit assemblies, such assemblies may also be used with chairs and the like.

Figure 6:
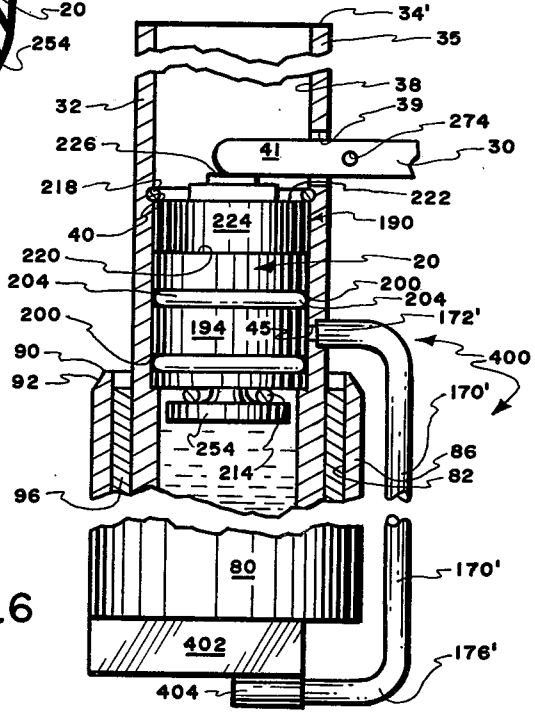
FIG. 6 is a fragmentary cross sectional view of a third form of the present invention.

Reference is now made to FIG. 6 which illustrates a third presently preferred form of the present invention, generally designated 400. Power unit 400 comprises a cylinder assembly identical to that previously described in conjunction with FIG. 2. Power unit 400 also comprises an actuator identical to that described in conjunction with FIGS. 1, 2, and 3 as well as a control valve 20, identical to the previously described control valve which is disposed within the hollow interior 38 of the ram 32 in the manner and at the site already described in conjunction with power unit 28 (FIG. 2). Accordingly, no further description of the cylinder assembly, actuator and control valve of power unit 400 is needed.

Power unit 400 is not equipped with a wrap-around annular reservoir containing oil or hydraulic fluid under pressure. In lieu thereof a reservoir 402 comprising a tank having liquid tight walls is provided. Reservoir 402, shown below the control valve but which may be disposed above the control valve, contains oil or hydraulic fluid under pressure which is continuously in communication with the hollow interior of hydraulic line 404. In turn hydraulic line 404 is coupled to elbow 176' of reverse curve dip tube 170'. Tube 170' spans a substantial vertical distance between the location of the control valve 20 and the reservoir 402, which is substantially below the control valve 20. The upper horizontal end 172' is force fit into previously described bore 47 so that the hollow interior of the dip tube 170' communicates with reduced diameter bore 45 which in turn communicates with control valve 20 in the manner and for the purpose heretofore described.

Thus, upon actuation of the lever 30 to open the control valve 20 as heretofore described, the effective length of the cylinder assembly will be extended by oil under pressure passing from reservoir 402 to the hollow interior 38 of tube 32 across control valve 20 provided no force is downwardly applied to upper end 35 of the tube 32. If sufficient force is applied to the upper end 35 of the tube 32, (for example the weight of the user), the opening of control valve 20 will cause the oil flow to be oppositely directed and the ram tube 32 to be telescopically retracted into the cylinder 80 of the cylinder assembly, to shorten the effective length of the power unit 400.

The invention may be embodied in other specific forms without departing from the spirit or essential characteristics thereof. The present embodiments are therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A power unit for stools, chairs and the like comprising:

a cylinder assembly comprising a cylinder, a ram which is caused to telescopically reciprocate within the cylinder, a control valve across which oil flows under pressure to change the effective length of the power unit by extending and retracting the ram in respect to the cylinder;

a cylindrical exterior reservoir tank located external of the cylinder assembly and comprising generally hollow liquid tight vertically elongated generally annular body means suspended from the ram to externally surround (a) a part of the ram other than the top end of the ram and (b) at least part of the cylinder, the body means comprising spaced inside and outside curved wall means and an oil reservoir under pressure disposed between the two wall means;

means accommodating flow of oil under pressure selectively across the control valve between the interior of the cylinder assembly and the interior of the surrounding vertically elongated reservoir tank to retract and extend the ram in respect to the cylinder as desired by the user.

2. A power unit in accordance with claim 1 wherein the two curved wall means of the generally annular body means are secured to each other in liquid tight relation at the lower portions thereof and are respectively secured at the upper portions thereof to the exterior of the ram at spaced sites.

3. A power unit according to claim 2 comprising port means in the ram between the spaced sites, the port means defining part of the oil flow path between the interior of the reservoir tank and the interior of the cylinder assembly.

4. A power unit according to claim 1 wherein compressed gas in the upper part of the reservoir tank and wherein the accommodating means comprise dip tube means one end of which extend into the oil contained in the reservoir with the other end being disposed above the oil level in the reservoir in communication with the control valve, the dip tube means thereby providing an oil flow path between the interior of the reservoir tank and the interior of the cylinder assembly.

5. A power unit according to claim 1 wherein the ram is hollow and the control valve is disposed within the hollow of the ram in liquid tight relation and wherein the accommodating means comprise port means between the interior of the reservoir tank and the interior of the ram, the port means being adjacent to and aligned with the control valve.

6. A power unit according to claim 1 wherein the top end of the ram is exposed for direct facile attachment to a seat or the like.

7. A power unit according to claim 1 wherein the ram, cylinder and reservoir tank are concentric.

8. A power unit for stools, chairs and the like comprising:

a cylinder assembly comprising a cylinder, a ram which is caused to telescopically reciprocate within the cylinder, a control valve across which oil flows under pressure to change the effective length of the power unit by extending and retracting the ram in respect to the cylinder;

an external reservoir tank disposed exterior of but at least partially coextensive with the cylinder assembly comprising generally cylindrical hollow liquid tight vertically elongated body means connected to the ram and surrounding a predetermined part of the exterior of the ram, the tank body means comprising spaced wall means and oil under pressure disposed between the two wall means;

means accommodating flow of oil under pressure selectively across the control valve between the interior of the cylinder assembly and the interior of the surrounding vertically elongated reservoir tank to retract and extend the ram in respect to the cylinder as desired by the user.

9. A power unit for stools, chairs and the like comprising:

a cylinder assembly comprising a cylinder and a ram which is caused to telescopically reciprocate within the cylinder to change the effective length of the power unit by extending and retracting the ram in respect to the cylinder;

a reservoir tank separate from the cylinder assembly containing oil under gas pressure and oil flow path-defining means accommodating selective flow of oil under pressure between the interior of the cylinder assembly and the interior of the reservoir tank;

the oil flow path-defining means comprising control valve means comprising a stationary valve member comprising a central bore and transverse passageway means by which oil passes between the bore and the exterior of the stationary valve member;

the control valve means further comprising a plunger reciprocably disposed within the central bore of the stationary valve member and comprising a valve head by which the control valve is open and closed to oil flow, passageway means in communication with the transverse passageway means of the stationary valve member and the valve head, and an exposed end remote from the valve head;

bias means disposed between the stationary valve member and the plunger urging the valve head into the closed position;

manual actuator means contiguous with the exposed end of the plunger by which the plunger may be displaced counter to the force of the bias means to open the valve head;

dual interior seal means interposed between the plunger and the central bore means and spaced from the plunger passageway means to prevent leakage of oil.

10. A power unit according to claim 9 wherein the ram is hollow and the control valve is disposed within the hollow of the ram and further comprising dual exterior seal means interposed between the stationary valve member and the ram to prevent oil leakage.

11. A power unit according to claim 9 further comprising valve head seal means interposed between the valve head and the stationary valve member.

12. A power unit according to claim 9 wherein the control valve means are carried by the reservoir tank in liquid tight relation.

13. A power unit according to claim 9 wherein the exposed end of the plunger comprises wear resistant means contiguous with the actuator means.

14. A power unit according to claim 9 wherein the plunger adjacent the plunger passageway means is of tapered reduced transverse dimension whereby the rate of extension and retraction of the ram can be manually controlled by the user.

15. A power unit for stools, chairs and the like comprising:

a cylinder assembly comprising a cylinder, a ram which is caused to telescopically reciprocate within the cylinder, a control valve across which oil flows under pressure to change the effective length of the power unit by extending and retracting the ram in respect to the cylinder;

a reservoir tank adjacent but spaced from the cylinder assembly and comprising generally hollow liquid tight body means comprising means by which the reservoir tank is mounted to a seat of the stool, chair or the like, the body means comprising spaced wall means and oil under pressure disposed between the wall means in the hollow of the body means;

oil communicating means spanning between the spaced cylinder assembly and the reservoir tank accommodating flow of oil under pressure selectively between the interior of the cylinder assembly and the interior of the reservoir tank to retract and extend the ram in respect to the cylinder as desired by the user.

16. A power unit according to claim 15 wherein the control valve is located at least in part within the reservoir tank.

17. A power unit according to claim 16 wherein the reservoir tank is recessed at one wall means thereof to expose the control valve for manual actuation.

18. A power unit for stools, chairs and the like comprising:

a cylinder assembly comprising a cylinder, a ram which is caused to telescopically reciprocate within the cylinder and a control valve across which oil flows under pressure to change the effective length of the power unit by extending and retracting the ram in respect to the cylinder;

a reservoir tank separate from the cylinder assembly forming a liquid tight reservoir of oil under pressure in the interior thereof;

the end of the ram disposed within the cylinder being hollow;

annular bearing means carried by the end of the ram disposed within the cylinder, the annular bearing means comprising a sleeve part of which is force-fit into the hollow interior of the ram at said ram end and the remainder of the sleeve extending beyond said ram end;

the annular bearing means further comprising an annular bearing carried in male/female relationship by and concentrically contiguously around the exposed part of the sleeve in close tolerance contiguous relation with the interior surface of the cylinder;

single interior seal means interposed between the annular bearing and the metal sleeve;

dual exterior seal means interposed between the annular bearing and the interior cylinder wall.

19. A power unit for stools, chairs and the like comprising:

a cylinder assembly comprising a cylinder, a ram which is caused to be telescopically reciprocated within the cylinder, a normally closed valve across which oil under pressure flows to change the effective length of the power unit by extending and retracting the ram in respect to the cylinder;

a separate reservoir tank forming a liquid tight reservoir of oil under pressure;

the ram being hollow at least in part and the control valve retained in liquid tight relation within the hollow of the ram;

the ram being transversely apertured directly beyond the control valve;

a manual actuator pivotally carried by the ram comprising a handle portion exposed beyond the ram and an interior portion contiguously associated with the control valve whereby manual rotation of the actuator causes the control valve to open accommodating flow of oil under pressure selectively across the control valve between the interior of the cylinder assembly and the interior of the reservoir tank.

20. A power unit for stools, chairs and the like comprising:

a cylinder assembly comprising a cylinder, a ram having a hollow interior, the ram being caused to telescopically reciprocate within the cylinder, a control valve disposed within the hollow interior across which oil flows under pressure to change the effective length of the power unit by extending and retracting the ram in respect to the cylinder;

a reservoir tank located adjacent but spaced from the cylinder assembly comprising generally hollow liquid tight body means comprising spaced wall means and oil under gas pressure disposed between the wall means in the hollow of the body means;

oil communicating means spanning between the control valve and the reservoir tank accommodating flow of oil under pressure of the gas or the pressure of the gas and weight of the user selectively between the interior of the cylinder assembly and the interior of the reservoir tank to selectively retract and extend the ram in respect to the cylinder as desired by the user.

21. A power unit according to claim 20 wherein the reservoir tank is disposed at an elevation substantially below the control valve and wherein the oil communicating means comprise dip tube means accommodating oil flow counter to gravity between the reservoir tank and the interior of the cylinder assembly.

* * * * *